US005703616A

United States Patent [19]

Kawasugi

[11] Patent Number: 5,703,616

[45] Date of Patent: Dec. 30, 1997

[54] DISPLAY DRIVING DEVICE

[75] Inventor: Kazuhiro Kawasugi, Oome, Japan

[73] Assignee: Casio Computer Co., Ltd., Tokyo, Japan

[21] Appl. No.: 428,269

[22] Filed: Apr. 25, 1995

Related U.S. Application Data

[62] Division of Ser. No. 238,254, May 4, 1994, abandoned.

[30] Foreign Application Priority Data

May 13, 1993 [JP] Japan ..... 5-111830

[51] Int. Cl.[6] ..... G09G 5/36

[52] U.S. Cl. ..... 345/98; 345/190; 345/200

[58] Field of Search ..... 345/190, 135, 345/98, 1, 200, 211; 395/750

[56] References Cited

U.S. PATENT DOCUMENTS

| | | | |
|---|---|---|---|
| 4,317,115 | 2/1982 | Kawakami et al. | 345/98 |
| 4,492,957 | 1/1985 | Marentic | 345/211 |
| 4,667,306 | 5/1987 | Smith | 345/135 |
| 4,740,786 | 4/1988 | Smith | 345/103 |
| 4,745,485 | 5/1988 | Iwasaki | 345/98 |
| 4,778,260 | 10/1988 | Okada et al. | 345/103 |
| 4,845,480 | 7/1989 | Satou | 345/1 |
| 4,878,194 | 10/1989 | Nakatsugawa et al. | 345/134 |
| 4,965,770 | 10/1990 | Yanagisawa | 345/190 |
| 5,040,874 | 8/1991 | Fukuda | 345/87 |
| 5,241,304 | 8/1993 | Munetsugu et al. | 345/98 |
| 5,412,777 | 5/1995 | Wakimoto | 345/200 |
| 5,515,540 | 5/1996 | Grider et al. | 395/750 |

FOREIGN PATENT DOCUMENTS

| | | |
|---|---|---|
| 0513551 A3 | 11/1992 | European Pat. Off. . |
| 2255668 | 11/1992 | United Kingdom . |

*Primary Examiner*—Richard Hjerpe
*Assistant Examiner*—Ricardo Osorio
*Attorney, Agent, or Firm*—Frishauf, Holtz, Goodman, Langer & Chick

[57] ABSTRACT

A display data memory which is provided in a segment driver for driving a liquid crystal display panel comprises a plurality of memories. Since the common Y address is provided to all the memories, one predetermined memory is selected when a predetermined X address is decoded. At the time of writing data, a predetermined area in one memory is addressed according to X and Y addresses, and then data is written in the predetermined area. In case data is read out to be displayed, the memories are prohibited from being selected according to outputs from decoders. Data addressed by the common Y address are read out from the memories. Therefore, display data of one line are output as segment signals at a time.

7 Claims, 7 Drawing Sheets

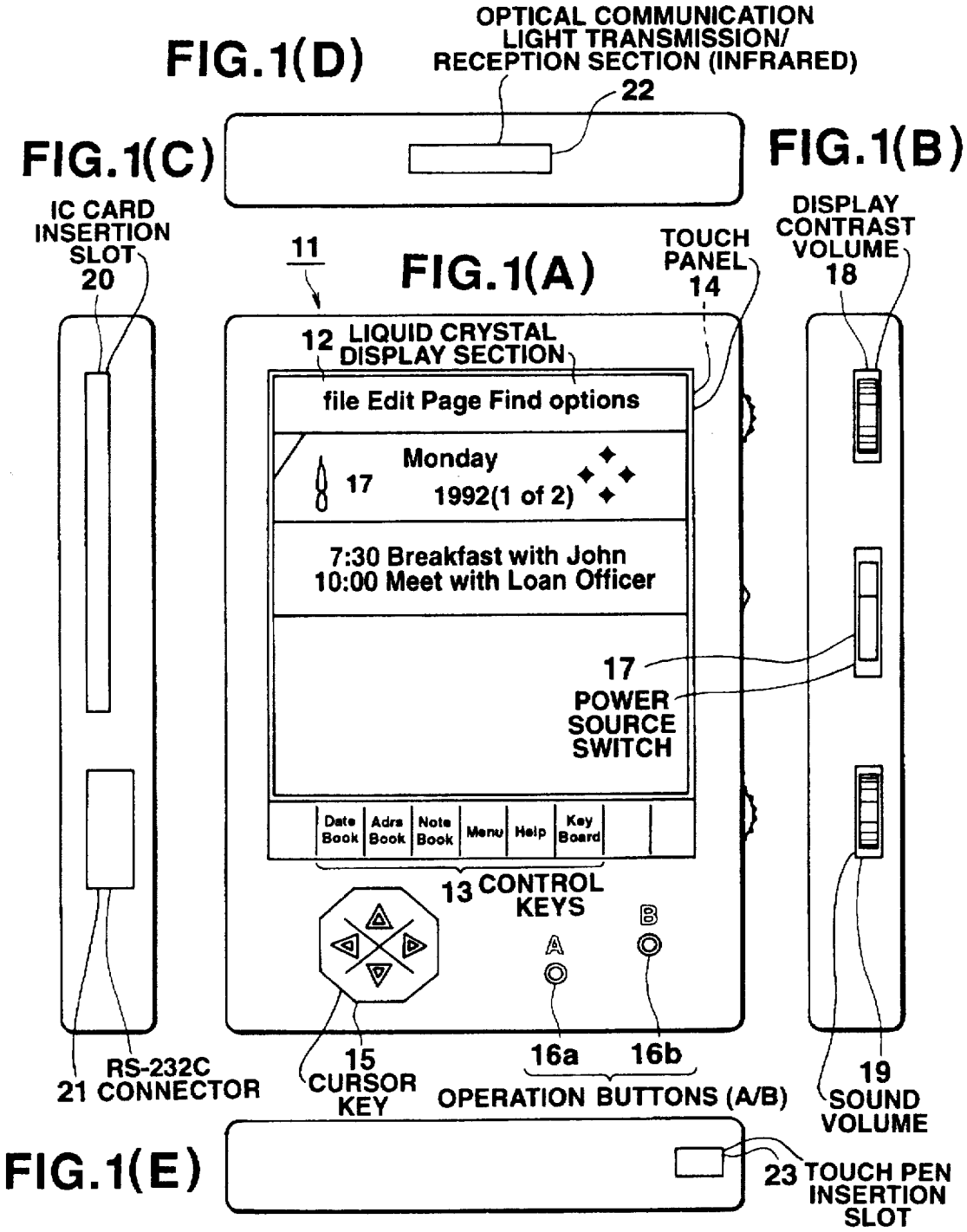
FIG.1(D)
OPTICAL COMMUNICATION LIGHT TRANSMISSION/ RECEPTION SECTION (INFRARED)
22
FIG.1(C)
FIG.1(B)
IC CARD INSERTION SLOT 20
11
FIG.1(A)
TOUCH PANEL 14
DISPLAY CONTRAST VOLUME 18
12 LIQUID CRYSTAL DISPLAY SECTION
file Edit Page Find options
Monday
17
1992(1 of 2)
7:30 Breakfast with John
10:00 Meet with Loan Officer
17
POWER SOURCE SWITCH
Date Book
Adrs Book
Note Book
Menu
Help
Key Board
13 CONTROL KEYS
A
B
RS-232C 21 CONNECTOR
15 CURSOR KEY
16a
16b
OPERATION BUTTONS (A/B)
19 SOUND VOLUME
FIG.1(E)
23 TOUCH PEN INSERTION SLOT

DISPLAY DRIVING DEVICE

This is a division of application Ser. No. 08/238,254 filed May 4, 1994, now abandoned.

BACKGROUND OF THE INVENTION

1. Field of the Invention

The present invention relates to a display driving device in an electronic device operated by a microprocessor built therein and, more particularly, to a display driver having a display memory for storing display data.

2. Description of the Related Art

In the conventional electronic data bank, for example, a key input section and display section are provided. Address data and schedule data which are previously input and stored in a semiconductor memory by the key operation are read out and displayed on the display section when required.

Generally, a liquid crystal display unit is used as the display section of this type of electronic device. Display data stored in a RAM used as the display memory is read out and output to the display section as follows as an instance. In particular, assume that an 8-bit data processing microprocessor is used and the liquid crystal display unit is constructed by 160 dots in height×128 dots in width, for example, and that, when an 8-bit data bus is connected thereto and display data is transferred from the RAM, the 8-bit data readout operations must be repeatedly effected 16 times in order to transfer one line of display data in a horizontal direction.

However, if the readout processes for 8 bits are repeatedly effected for the display memory as described above, it takes a long time to read out the entire display data, and the power consumption becomes large since a large number of memory accesses must be effected.

SUMMARY OF THE INVENTION

The present invention has been made in order to solve the above drawback, and an object of the present invention is to provide a display device in which the display data readout time can be reduced and the power consumption can be reduced.

According to an aspect of the present invention, there is provided a segment driving circuit of a liquid crystal display panel for effecting the displaying operation by selectively driving a group of common electrodes and a group of segment electrodes, comprising a display memory for storing display data displayed on the liquid crystal display panel; an address data memory having a write-in address register for storing data write-in address data for the display memory and a readout address register for storing data readout address data; a data write-in circuit for writing data into the display memory according to the address data stored in the write-in address register; a data readout circuit for reading out display data of one line for one common electrode to be supplied to the segment electrode group at one time from the display memory according to the address data stored in the readout address register; a bus for transferring the display data of one line read out from the display memory in a parallel form; a segment data memory connected to the bus, for storing display data of one line read out by the data readout circuit; and a segment signal generation circuit for driving the segment electrode group according to the display data stored in the segment data memory.

According to another aspect of the present invention, there is provided a display data storing device in which a memory area is specified by an X address and Y address, comprising a plurality of memories of a number which can be specified by the X address, for storing display data; write-in means for specifying one of the plurality of memories by the X address and Y address and writing data into the specified memory; and readout means for specifying all of the plurality of memories by the Y address to simultaneously read out data.

According to still another aspect of the present invention, there is provided an electronic device having a liquid crystal display, comprising a display dot matrix type liquid crystal display panel having a display area divided into a plurality of areas; a common driver for driving a common electrode of the liquid crystal display panel; a plurality of segment drivers for the respective divided display areas and having a display memory for storing display data displayed on the divided display areas, for driving segment electrodes of the liquid crystal display panel; a control device for controlling the operation of the electronic device; and a connection bus for connecting the control device to the segment drivers; wherein the control device includes transmission means for transmitting address data for the display memory of the segment driver and display data stored in the display memory to the connection bus; and each of the segment drivers includes determination means for determining whether the segment driver itself is selected or not based on address data transmitted via the connection bus, and write-in means for writing transmitted display data into a corresponding address location when it is determined that the segment driver itself is selected.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1(A)–1(E) are external views showing the construction of an electronic device having a display device according to an embodiment of the present invention;

in FIG. 1;

DETAILED DESCRIPTION OF THE PREFERRED EMBODIMENT

Figure 2:
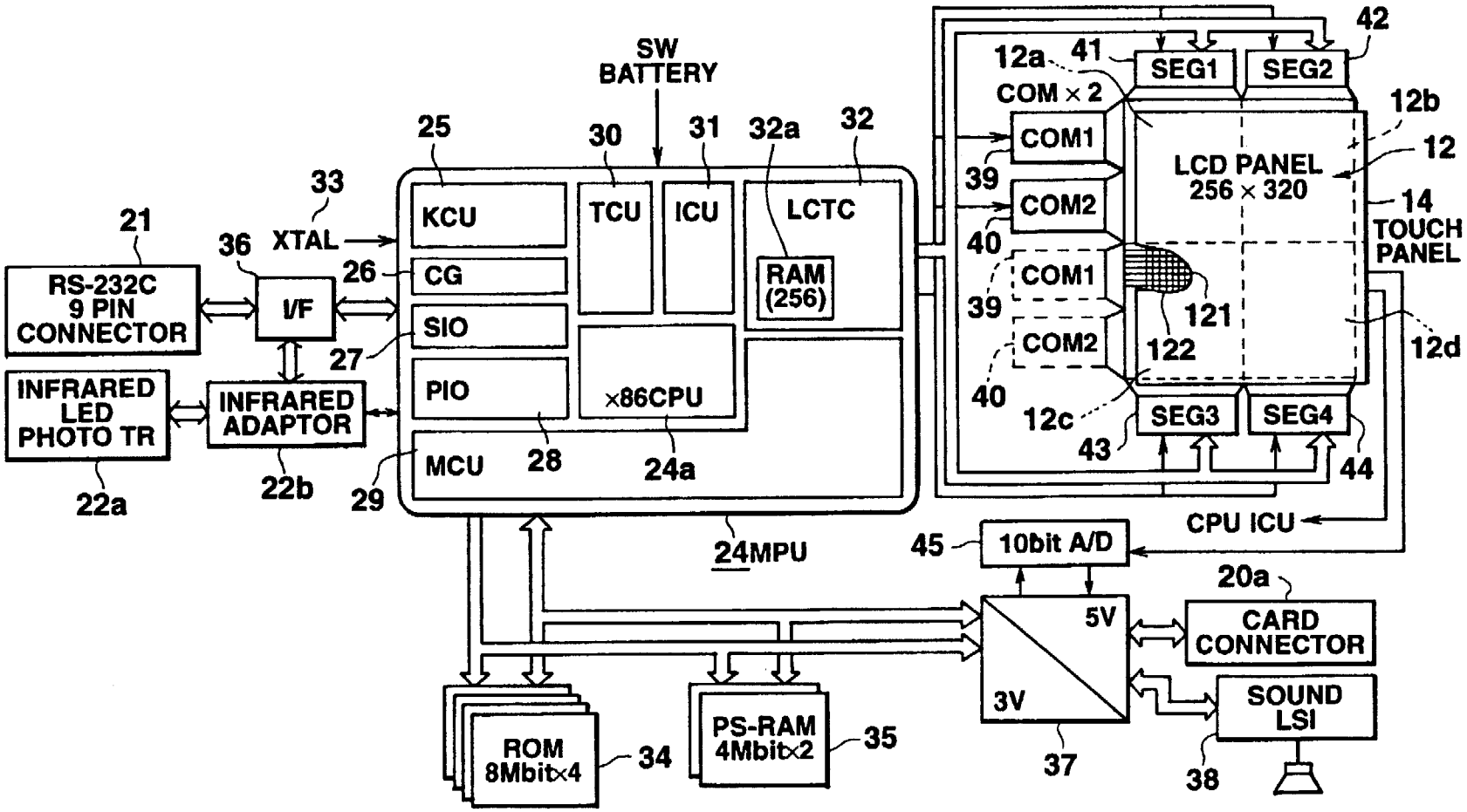
FIG. 2 is a block diagram showing the construction of an electronic circuit of the electronic device.

There will now be described an embodiment of the present invention with reference to the accompanying drawings.

FIGS. 1(A)–1(E) are external views showing the construction of an electronic device called a personal digital assistant (PDA) having a display device of the present invention mounted thereon. FIG. 1(A) is a front view, FIG. 1(B) is a right side view, FIG. 1(C) is a left side view, FIG. 1(D) is a top plan view and FIG. 1(E) is a bottom view.

On the front central portion of the PDA main body 11, a liquid crystal display section 12 of 320 dots in height×256 dots in width is arranged. Various control keys 13 such as a "Date Book" key operated at the time of registration/readout of schedule data, "Adrs Book" key operated at the time of registration/readout of address data, and "Key Board" key operated at the time of setting of key input mode are arranged along the lower end of the liquid crystal display section 12 on the front lower portion of the main body 11. The surfaces of the liquid crystal display section 12 and control keys 13 are covered with a transparent touch panel 14. According to various mode setting states, processes such as input, designation and selection of data can be effected by setting a touch pen (not shown) in contact with the touch panel 14.

On the front lower portion of the PDA main body 11, a cursor key 15 operated for moving the cursor displayed on the liquid crystal display section 12 and operation buttons (A/B) 16*a*, 16*b* are arranged.

On the right side surface of the PDA main body 11, a power source switch 17 operated for switching the ON/OFF state of the power source, a display contrast volume 18 operated for adjusting the contrast on the liquid crystal display section 12, and a sound volume 19 operated for adjusting the sound volume of an electronic sound generated to inform the operation state of the PDA main body 11 are disposed.

On the left side surface of the PDA main body 11, an IC card insertion slot, which permits connection with IC cards such as a RAM card used as an external expansion memory and a ROM card for storing application programs, and an RS-232C connector 21, which permits connection with an external information processing device such as a personal computer, are disposed.

On the upper side surface of the PDA main body 11, an optical communication light transmitting/receiving section 22 for effecting data communication with the external information processing device by optical communication using infrared is disposed. A touch pen insertion slot 23 for receiving a touch pen (not shown) used for touching the touch panel 14 is formed in the lower side surface of the main body 11.

FIG. 2 is a block diagram showing the construction of an electronic circuit of the PDA. The electronic circuit includes a main control device (MPU) 24 for controlling the operations of respective circuit sections. The main control device 24 includes a central processing unit (X86 CPU) 24*a*, a key controller (KCU) 25 for controlling the input process of key operation signals in the touch panel 14, a clock generator (CG) 26 for effecting the time-counting operation according to a crystal oscillation signal (XTAL) 33 supplied to the main control device 24, a serial input/output section (SIO) 27 for controlling the input/output of serial data, a parallel input/output section (PIO) 28 for controlling the input/output of parallel data, a memory controller (MCU) 29 for controlling data access to a ROM (8 Mbit×4) 34 and PS-RAM (4 Mbit×2) 35, a timer controller (TCU) 30 for counting and detecting elapsed time of data supplied from the central processing unit 24*a* for a preset period of time, an interrupt controller (ICU) 31 for controlling the input process of an interruption signal such as a key input signal, and a liquid crystal timing controller (LCTC) 32 for controlling the timings of display by the liquid crystal display section 12.

The liquid crystal timing controller 32 has a RAM 32*a* of 256 bytes disposed therein and image data such as a cursor, pattern or symbol to be combined with display data for the liquid crystal display section 12 is written into the RAM 32*a*.

A system program for controlling the operation of the PDA circuit and application programs used for various setting modes are previously stored in the ROM 34.

The PS-RAM 35 is a pseudo-static RAM, a VRAM (video memory) for storing display data is disposed in the PS-RAM 35. Address data and message data registered by users are adequately stored in the RAM.

The main control device 24 is connected to the RS-232C connector 21 via an interface 36 and an infrared phototransistor 22*a* provided in the optical communication light transmitting/receiving section 22 is connected to the main control device 24 via an adaptor 22*b* and the interface 36.

Further, the electronic circuit of the PDA includes a voltage converting section 37 constructed by gate arrays and makes it possible to transfer input/output data between the touch panel 14, IC card connector 20*a*, and sound LSI 38 for electronic sound generation which are operated on 5 V (volts) and the main control device 24 operated on 3 V (volts).

The liquid crystal display section 12 is divided into first to fourth display sections 12*a* to 12*d* each having an area of 160 dots in height×128 dots in width. That is, the common signal electrodes 121 of the liquid crystal display section 12 are divided into two portions, upper and lower portions and 160 common lines of each of the upper and lower portions are commonly driven by a first common driver (COM1) 39 and a second common driver (COM2) 40 each of which outputs 80 common signals.

The segment signal electrodes 122 are divided into two portions and 128 segment lines are respectively driven by first segment driver (SEG1) 41 to fourth segment driver (SEG4) 44 corresponding to the first to fourth display sections 12*a* to 12*d*.

The common drivers 39, 40 and the segment drivers 41 to 44 of the liquid crystal display section 12 are supplied with timing signals and display data from the liquid crystal timing controller 32 of the main control device 24.

The touch operation signal for the touch panel 14 is supplied to the interrupt controller 31 of the main control device 24 as an interrupt signal and analog data indicating the touching position is converted into 10-bit digital data by an A/D converter 45 and output to the key controller 25 of the main control device 24.

That is, in the liquid crystal display section 12, when the first common line in the first to fourth display sections 12*a* to 12*d* is driven by the first common driver 39, segment lines are driven based on display data of first horizontal line stored in the segment drivers 41 to 44.

After this, second, third and succeeding common lines are sequentially driven so that 160 common lines in the first and second display sections 12a, 12b, which correspond to the upper half of the liquid crystal display section 12, and 160 common lines in the third and fourth display sections 12c, 12d, which correspond to the lower half of the liquid crystal display section 12, can be simultaneously driven in a parallel manner. Display data for the whole portion of one display image can be displayed.

SEGMENT DRIVER CIRCUIT

Figure 3:
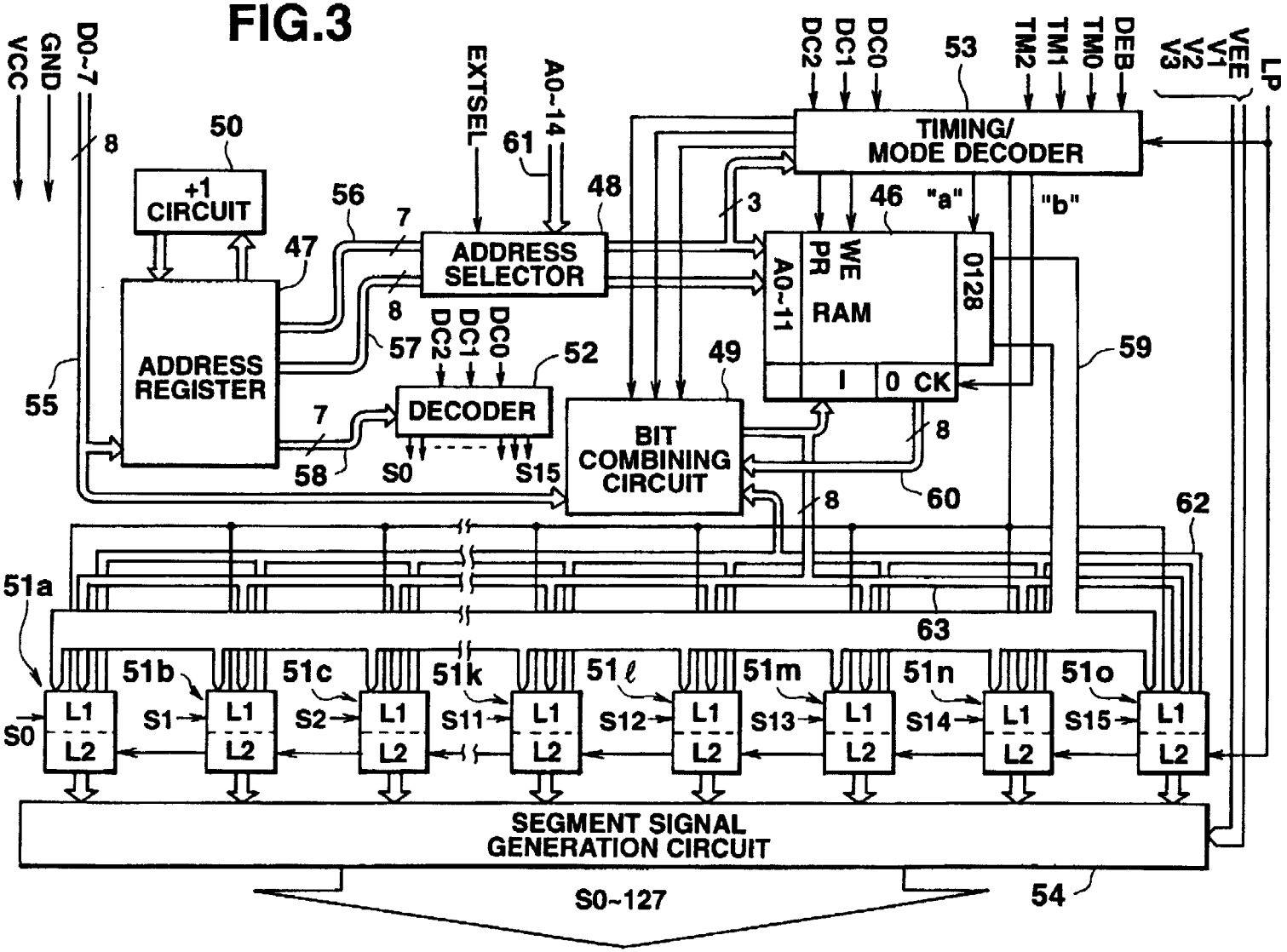
FIG. 3 is a block diagram showing the circuit construction of a segment driver for a liquid crystal display section of the electronic device.

FIG. 3 is a block diagram showing the circuit construction of the first segment driver 41 for the liquid crystal display section 12 of the PDA. Each of the second segment driver 42 to the fourth segment driver 44 has the same construction as the first segment driver 41 and the explanation therefor is omitted.

The first segment driver 41 has a display RAM 46 which can store display data of 160 dots in height×128 dots in width to be displayed on the first display section 12a corresponding to its own display area.

Address data and display data for the display RAM 46 are supplied from the liquid crystal timing controller 32 of the main controller 24 via an 8-bit data bus 55 (D0 to D7) in a time sharing technique. The address data supplied via the 8-bit data bus 55 (D0 to D7) is stored in the address register 47. The content of the address register 47 is supplied to the address port of the RAM 46 via a selector 48. Further, the transmitted display data is supplied to the input port of the RAM 46 via a bit combining circuit 49.

Figure 4:
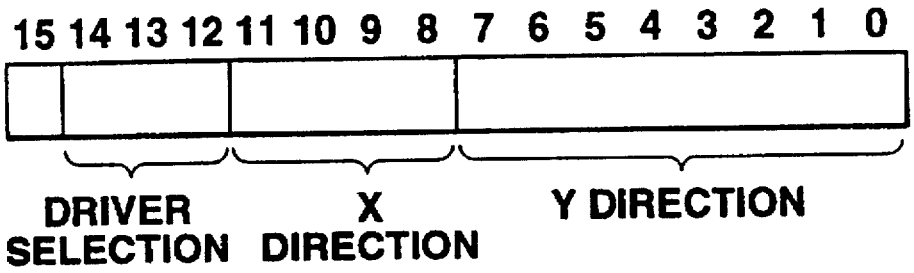
FIG. 4 is a diagram showing the structure of write-in address data necessary for writing data into a display RAM in the segment driver in FIG. 3.

FIG. 4 is a diagram showing the structure of write-in address data necessary for writing data into the display RAM 46 in the segment driver of the PDA. In the upper 12th to 14th bit positions of the address data, the 3-bit driver selection data is set, in the 8th to 11th bit positions thereof, the 4-bit X address is set, and in the 0th to 7th bit positions thereof, the 8-bit Y address is set. 3-bit driver selection data for specifying one of the first to fourth segment drivers is supplied together with the address data from the data bus 55 (D0 to D7). For example, if the driver selection data is "000", the first segment driver 41 is selected. If the driver selection data is "001", the second segment driver 42 is selected. If the driver selection data is "010", the third segment driver 43 is selected. If the driver selection data is "100", the fourth segment driver 44 is selected. Since display data is supplied via the data bus 55 (D0 to D7) 8 bits at a time, display data must be written into the RAM 46 by 16 times to prepare 128 bits in the horizontal direction (X direction). Therefore, the X address is designated by 4-bit address data. Further, the Y address is designated by 8-bit address data which can designate 256 addresses to cope with 160 bits in the vertical direction (Y direction). That is, the whole portion of the data write-in address data is constructed by 15 bits. When the write-in address data is supplied from the MPU 24 via the data bus 55 (D0 to D7), the address data is supplied 8 bits at one time in each of two separate cycles.

Figure 5:
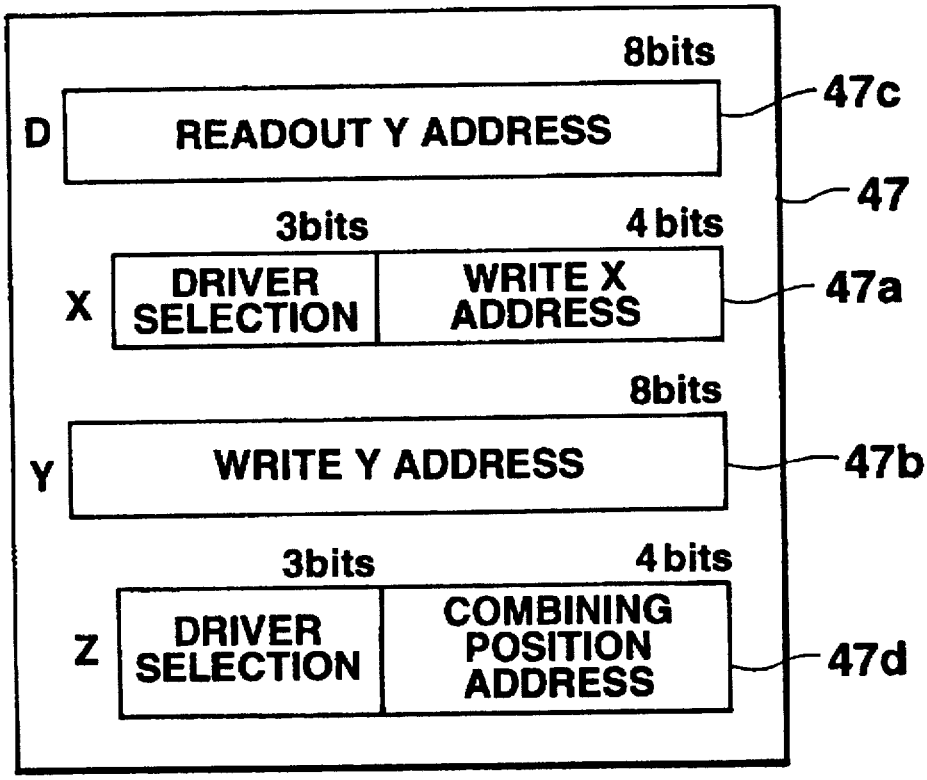
FIG. 5 is a diagram showing the construction of an address register in the segment driver in FIG. 3.

FIG. 5 is a diagram showing the construction of the address register 47 in the segment driver of the PDA. The address register 47 includes an X register 47a, Y register 47b, D register 47c and Z register 47d. The X register 47a and Y register 47b are used as a write-in address register, which stores write-in address data for write-in of the display data. The D register 47c holds Y address data, which is used for readout of the display data from the display RAM 46. The value of each register is sequentially incremented by a +1 circuit (increment circuit) 50. Therefore, each of the registers can be used as an address counter. The Z register 47d is used as a display latch selection register which holds address data used for designating one of latch circuits 51a to 51o when part of the display data read out from the display RAM 46 to the display latch circuits 51a to 51o corresponding to the respective segment lines is subjected to the combining process.

At the time of write-in process of the display data, the write-in address data stored in the X register 47a and the Y register 47b of the address register 47 is transferred to the address selector 48 via the respective 7-bit bus 56 and 8-bit bus 57. At the time of readout process of the display data, the readout Y address data held in the D register 47d is transferred to the address selector 48 via the 8-bit bus 57. Further, at the time of combining process of the display data, address data, which designates the latch circuit for combining the display data held in the Z register 47d of the address register 47, is transferred to a decoder 52 via the 7-bit data bus 58.

Driver selection data, which designates the segment driver corresponding to combination data supplied from the LCTC 32 via the 8-bit bus 55 (D0 to D7), is set in the upper 3 bit positions of the combination display latch selection data held in the Z register 47d. The 4-bit combination position address data, which designates one of the display latch circuits 51a to 51o as the destination of combination of the display data, is set in the lower 4 bit positions of the latch selection data.

At the time of write-in process of the display data, the 3-bit driver selection data among the write-in address data output from the address selector 48 is supplied to a timing/mode decoder 53 whereas the 4-bit X address data and the 8-bit Y address data are supplied to an address port (A0 to A11) of the display RAM 46. In the timing/mode decoder 53, the driver selection data is compared with identifying codes ("000" in the first segment driver 41), which are previously set in the input terminals (DC0) to (DC2) and inherent to the segment driver. A coincidence between the driver selection data and the identifying codes is then checked.

If the coincidence between the identifying code and the driver selection data is determined in the timing/mode decoder 53, a write enable signal WE is output to the display RAM 46, and write-in X and Y addresses supplied from the address selector 48 to the address port (A0 to A11) are made valid.

Further, at the time of readout of the display data, the address selector 48 supplies an 8-bit readout Y address from the D register 47d to the address port (A0 to A11) of the display RAM 46. In this case, either a batch readout signal "a" used for simultaneously reading out display data of one line in the horizontal direction (X direction) or a divisional readout signal "b" used for reading out the display data every 8 bits at a time is output from the timing/mode decoder 53. The batch readout signal "a" is supplied to a 128-bit batch output port ($\bar{O}$128) of the display RAM 46. The divisional readout signal "b" is supplied to the 8-bit output port ($\bar{O}$) of the display RAM 46. 128-bit display data of one horizontal line read out from the batch output port ($\bar{O}$128) of the display RAM 46 is transferred through a 128-bit bus 59, and is distributed to and held in the display latch circuits 51a to 51o 8 bits at a time. The 8-bit display data read out from the output port ($\bar{O}$) of the display RAM 46 is transferred to the bit combining circuit 49 through a 8-bit bus 60.

The address selector 48 of the segment driver 41 is designed to permit address data to be directly input to the display RAM 46 via the 15-bit bus 61 (A0 to A14) so as to cope with a case wherein another MPU is used. In this case, it is determined by a switching signal EXTSEL whether RAM address data is input via the address register 47 or via the 15-bit bus 61 (A0 to A14). In this embodiment, the 15-bit bus 61 is not used.

The bit combining circuit 49 effects the passing/transferring process or combining/transferring process of display data supplied via the data bus. A designation specifying signal of the combining process (AND, OR, EXOR) for the bit combining circuit 49 is supplied from the timing/mode decoder 53 based on the instruction from the MPU 24. At the time of write-in process of the display data, the bit combining circuit 49 passes and transfers display data, which is sequentially supplied from the MPU 24 via the 8-bit data bus 55 (D0 to D7) every 8 bits at a time, towards the input port (I) of the display RAM 46. Further, at the time of combining process of the display data on the display screen, combination data supplied from the MPU 24 via the 8-bit data bus 55 (D0 to D7) is combined with 8-bit display data, which is selectively read out from one of the display latch circuits 51*a* to 51$\bar{o}$ through a 8-bit bus 62, and then transferred back to the same one of the display latch circuits 51*a* to 51$\bar{o}$ through a 8-bit bus 63.

In the case of the combining process for rewriting display data stored in the display RAM 46, 8-bit display data read out from the output port ($\overline{O}$) of the display RAM 46 and combination data supplied from the MPU 24 are combined by the bit combining circuit 49 and then transferred to the input port (I) of the display RAM 46.

At the time of process for combining display data on the display screen, the decoder 52 determines coincidence/non-coincidence between the upper 3-bit driver selection data held in the Z register 47*d* of the address register 47 and the driver identifying code ("000" in the first segment driver 41) previously set as (DC0) to (DC2) and inherent to the segment driver. When the result of determination indicates coincidence, the lower 4-bit combination latch position address data held in the Z register 47*d* is decoded and one of the display latch circuits 51*a* to 51*o* is specified as the destination of combination of the display data and latch position specifying signals S0 to S15 thereof are output. Therefore, for example, if the latch specifying signal S0 is output from the decoder 52 and the display latch circuit 51*a* corresponding to 0th to 7th bits of the one-line display data is specified as the destination of combination of the display data, 8-bit display data held in the display latch circuit 51*a* is transferred to the bit combining circuit 49 through the 8-bit bus 62 and combined with combination data supplied via the 8-bit data bus 55 (D0 to D7) and then transferred to the display latch circuit 51*a* and held therein.

In this example, each of the display latch circuits 51*a* to 51$\bar{o}$ has first and second latch sections L1, L2, display data read out from the simultaneous readout port (O128) of the display RAM 46 or data from the bit combining circuit 49 is latched into the first latch section L1 8 bits at a time, and display data output to the segment signal generation circuit 54 according to common line driving signals from the common drivers 39, 40 is shifted from the first latch section L1 and latched into the second latch section L2.

That is, display data latched in the first latch section L1 of the display latch circuits 51*a* to 51*o* is shifted to and latched into the second latch section L2 according to a latch pulse (LP) based on the common line driving signal and then output to the segment signal generation circuit 54 so as to drive the segment lines (S0 to S127) according to the display data.

The segment signal generation circuit 54 selects a display driving voltage (V1, V2, V3, VEE) according to 128-bit display data supplied from the second latch section L2 of each of the display latch circuits 51*a* to 51*o* and drives the segment lines of the liquid crystal display section 12 (in this case, first display section 12*a*), and at this time, display data of one line commonly driven is displayed on the liquid crystal display section 12.

Figure 6:
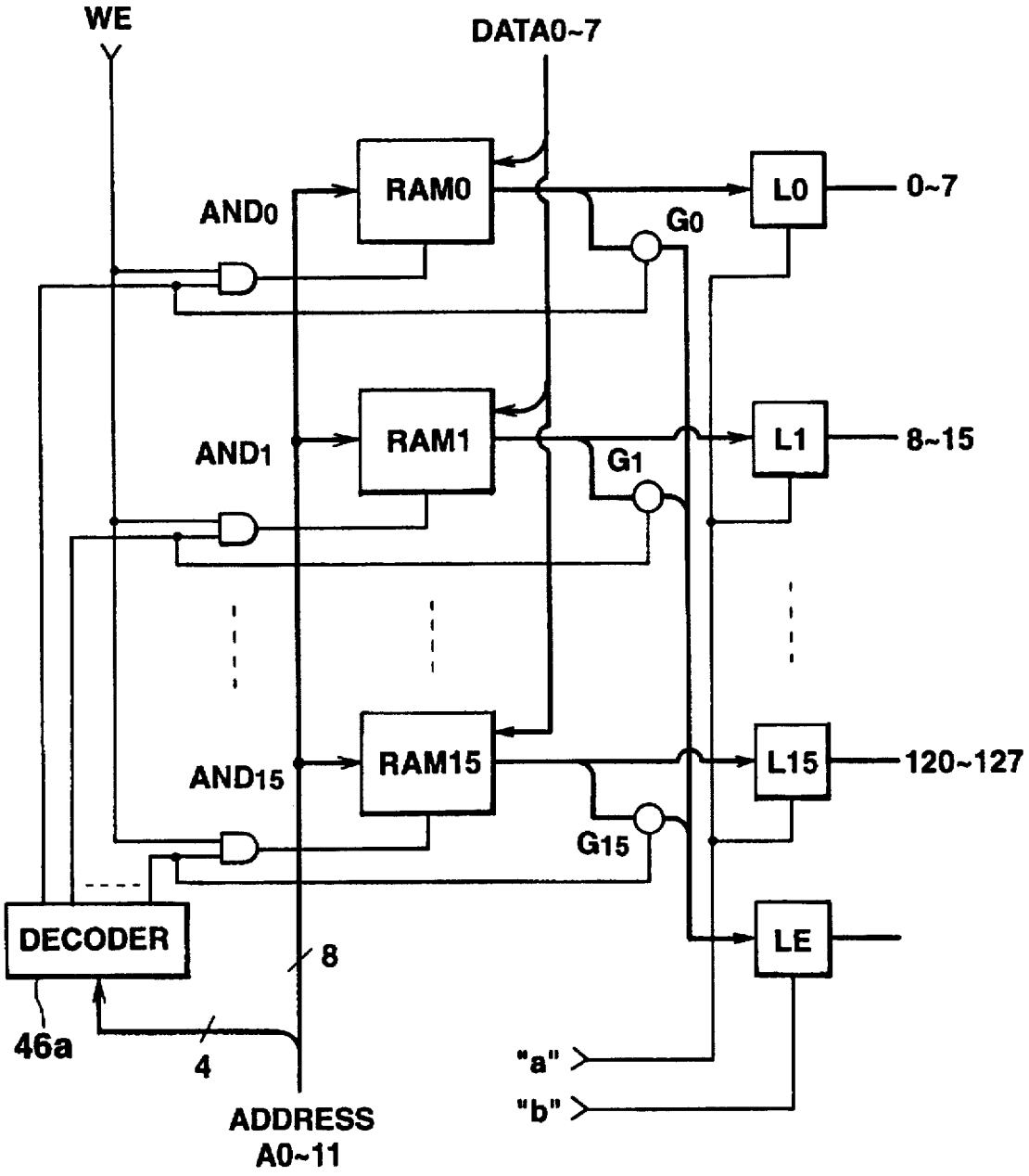
FIG. 6 is a circuit diagram showing the internal construction of the display RAM in the segment driver in FIG. 3.

FIG. 6 is a circuit diagram showing the internal construction of the display RAM 46 in the above segment driver. The display RAM 46 includes 16 RAMs RAM0 to RAM15. The display data of 160 bits in the vertical direction (Y direction) ×128 bits in the horizontal direction (X direction) is divided by 16 in the horizontal direction, and each divided display data is stored in the corresponding RAM. Display data transferred via the bit combining circuit 49 is written 8 bits at a time into a specified area of the 16 RAMs RAM0 to RAM15 according to the write-in X address and Y address input to the address port (A0 to A11).

That is, a 4-bit X address among the data input to the address port (A0 to A11) is input to the decoder 46*a* and decoded into a RAM specifying signal for specifying the 16 RAMs RAM0 to RAM15. The decoder output is supplied to the RAMs RAM0 to RAM15 via the AND gates AND0 to AND15 enabled by a write enable signal WE from the timing/mode decoder 53 to set the same into the write-in mode. Thus a data write-in circuit is composed of the decoder 46*a*, AND gates AND0 to AND15 and the timing/mode decoder 53.

Further, an 8-bit Y address among the data input to the address port (A0 to A11) is supplied as a common Y address to the 16 RAMs, RAM0 to RAM15.

Output lines of RAM0 to RAM15 are connected to 8-bit output latch sections L0 to L15 and the output latch sections L0 to L15 are supplied with the batch readout signal "a" from the timing/mode decoder 53 as a latch pulse for readout of the display data.

That is, when the batch readout signal "a" is supplied to the output latch sections L0 to L15, a Y address common to RAM0 to RAM15 is designated according to a readout Y address designated to the address port (A0 to A11) so that all of the 8-bit display data items stored in the RAMs can be read out and latched into the corresponding output latch sections L0 to L15 as 128-bit display data of one line.

The 128-bit display data of one line latched in the output latch sections L0 to L15 is transferred in parallel from the simultaneous output port ($\bar{O}$128) to the display latch circuits 51*a* to 51*o* and latched and held in the first latch sections L1 thereof. Thus a data readout circuit is composed of the latch circuits 51*a* to 51*o* and the timing/mode decoder 53.

Further, the output lines of RAM0 to RAM15 are connected to gates G0 to G15 which are enabled by a RAM specifying signal corresponding to the X address from the decoder 46*a* and 8-bit display data selectively read out from RAM0 to RAM15 via one of the gates G0 to G15 is latched into the output latch section LE and is transferred from the 8-bit output port ($\overline{O}$) to the bit combining circuit 49.

That is, when the display RAM 46 is supplied with a write enable signal WE from the timing/mode decoder 53, 8-bit display data is sequentially written into RAM0 to RAM15 according to write-in X and Y addresses held in the X and Y registers of the address register 47. When the display RAM 46 is supplied with the batch readout signal "a" from the timing/mode decoder 53, all of the 8-bit display data items from all of the RAMs, RAM0 to RAM15, are simultaneously read out to the display latch sections 51*a* to 51*o* via the output latch sections L0 to L15 as 128-bit display data of one line, according to a readout Y address held in the D register of the address register 47.

DISPLAY DATA WRITE-IN OPERATION

Next, the display data write-in operation of the segment driver of the PDA of the above construction is explained.

Figure 7:
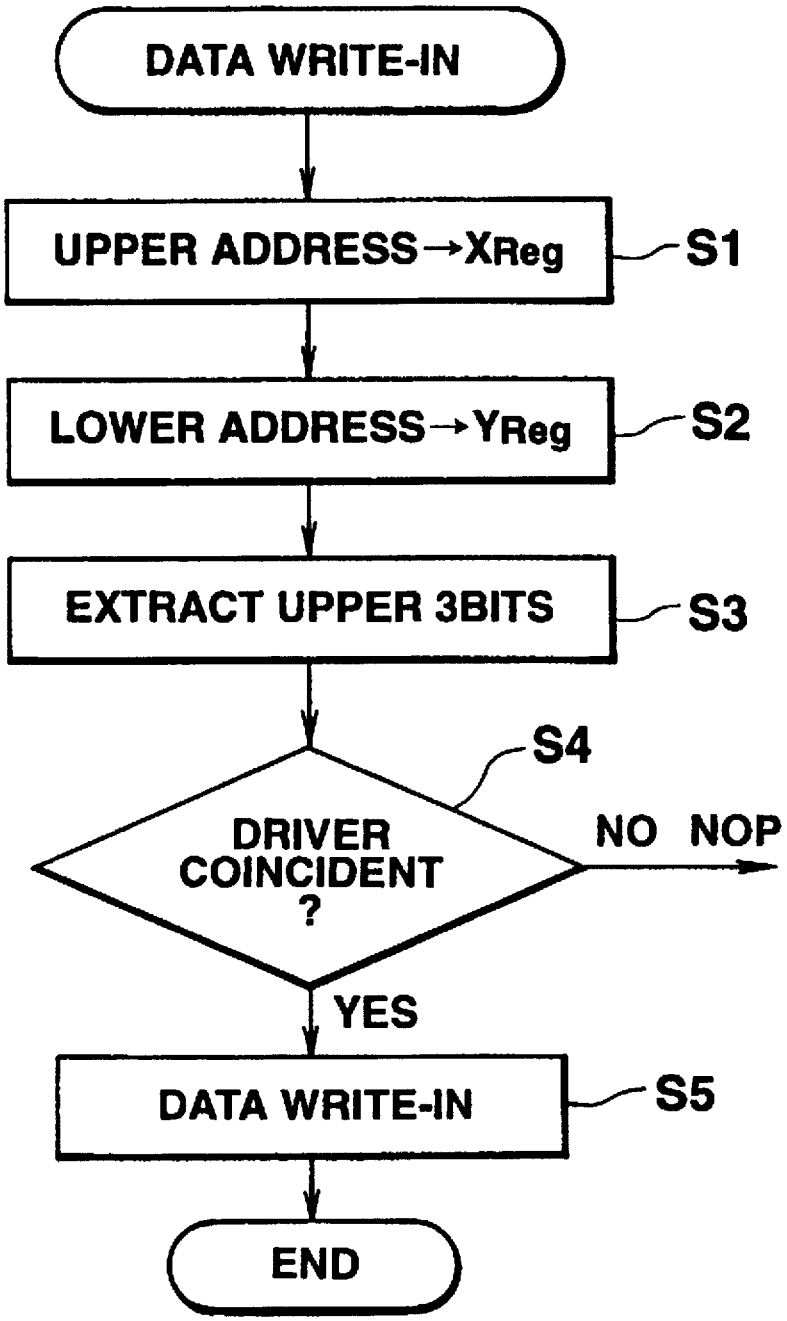
FIG. 7 is a flowchart for illustrating the display data writing operation for the display RAM in the segment driver of the electronic device.

FIG. 7 is a flowchart for illustrating the display data writing operation for the display RAM 46 in the segment driver of the personal digital assistant. In a case where the MPU 24 writes display data into the display RAM 46 of the segment driver, it basically outputs upper address data (7 bits) and lower address data (8 bits) and then sequentially supplies the display data (8 bits). The segment driver fetches upper 7-bit address data for writing constructed by 3-bit driver selection data and 4-bit X address via the 8-bit data bus 55 (D0 to D7) and sets the same into the X register 47*a* of the address register 47 (block S1).

Following the write-in upper address, when lower address data constructed by an 8-bit Y address is supplied via the 8-bit data bus 55 (D0 to D7), it is set into the Y register 47*b* of the address register 47 (block S2).

The upper 3-bit driver selection data held in the X register 47*a* is supplied to the timing/mode decoder 53 via the address selector 48 (block S3). Further, the lower 4-bit X address held in the X register 47*a* and 8-bit address held in the Y register 47*b* are supplied to the address port (A0 to A11) of the display RAM 46 via the address selector 48.

At this time, whether the driver selection data supplied to the timing/mode decoder 53 is coincident or non-coincident with an identifying code ("000" in the first segment driver 41) inherent to the segment driver previously set as (DC0) to (DC2) in the timing/mode decoder 53 is determined by comparison (block S4).

When it is determined by the timing/mode decoder 53 that the driver selection data is coincident with the identifying code inherent to the segment driver, the write enable signal WE is supplied to the 16 AND gates AND0 to AND15 in the display RAM 46.

Then, one of the RAMs RAM0 to RAM15 is specified via the decoder 46*a* according to the X address supplied to the address port (A0 to A11) of the display RAM 46 and a Y address of the specified RAM is designated by the Y address supplied to the same address port (A0 to A11) so as to permit 8-bit display data supplied via the 8-bit data bus 55 (D0 to D7) following the write-in address data to be sequentially written.

For example, when one-line data is written, the write-in operation can be effected by incrementing the content of the X address register 47*a* by 15 times. Further, display data of 128 bits in width×160 bits in height in the occupied area of the segment driver can be written by repeatedly effecting the write-in operation for writing the display data of one horizontal line while incrementing the content of the Y address register 47*b* by 160 times.

DISPLAY OPERATION

Next, the display operation in the segment driver of the personal digital assistant is explained.

In the display operation on the liquid crystal display section 12, a latch pulse LP output from the liquid crystal timing controller 32 in the main control device 24 is supplied to the timing/mode decoder 53. The batch readout signal "a" is supplied from the timing/mode decoder 53 to the batch output port ($\overline{0}$128) of the display RAM 46. At this time, readout Y address data held in the D register 47*c* of the address register 47 is supplied to the address port (A0 to A11) of the display RAM 46 via the address selector 48. The 8-bit display data items in the 16 RAMs, RAM0 to RAM15, for the Y address are simultaneously read out and latched in the respective output latch sections L0 to L15.

Then, 128-bit display data of one line latched in the output latch sections L0 to L15 of the display RAM 46 is distributed to the display latch circuits 51*a* to 51$\overline{o}$ and latched into the first latch sections L1 of the respective display latch circuits.

In this case, if a first common line in the Y direction is driven by the common driver 39, display data latched in the first latch sections L1 of the display latch circuits 51*a* to 51$\overline{o}$ is shifted to and latched into the second latch sections L2 according to the latch pulse LP and output to the segment signal generation circuit 54.

As a result, the segment line of the first display section 12*a* which is the occupied area of the first segment driver 41 is driven according to the display data of one line to effect the liquid crystal display for the first common line.

At this time, the readout Y address held in the D register 47*c* of the address register 47 is counted up by the +1 circuit (increment circuit) 50 and 128-bit display data of second line is simultaneously read out from the simultaneous read-out port (O128) of the display RAM 46 and transferred to and latched into the first latch sections L1 of the respective display latch sections 51*a* to 51*o* as display data used when the common line is next driven.

After this, the 128-bit display data of one line is sequentially read out and transferred to the display latch circuits 51*a* to 51*o* according to the readout Y address which is sequentially incremented each time the common line is driven and thus the display operation on the first display section 12*a* by the first segment driver 41 is effected.

The display data readout process which is the same as that effected in the first segment driver 41 is effected in the second to fourth segment drivers 42 to 44 and thus the display process for the entire area of the liquid crystal display section 12 is effected.

That is, at the time of readout and display process of display data from the display RAM 46 in each of the segment drivers 41 to 44, all of the display data of one line (128 bits) in the display RAM 46 is sequentially read out according to the readout Y address sequentially incremented by the +1 circuit 50 in the D register 47*c* of the address register 47. The read-out one line display data is latched in the display latch circuits 51*a* to 51*o* and simultaneously output to the segment signal generation circuit 54 by driving the common line, and therefore, the display processing speed can be enhanced and the number of memory accesses is reduced, thereby reducing the power consumption.

DISPLAY DATA COMBINING OPERATION

Next, the display data combining operation in the segment driver of the personal digital assistant is explained.

Figure 8:
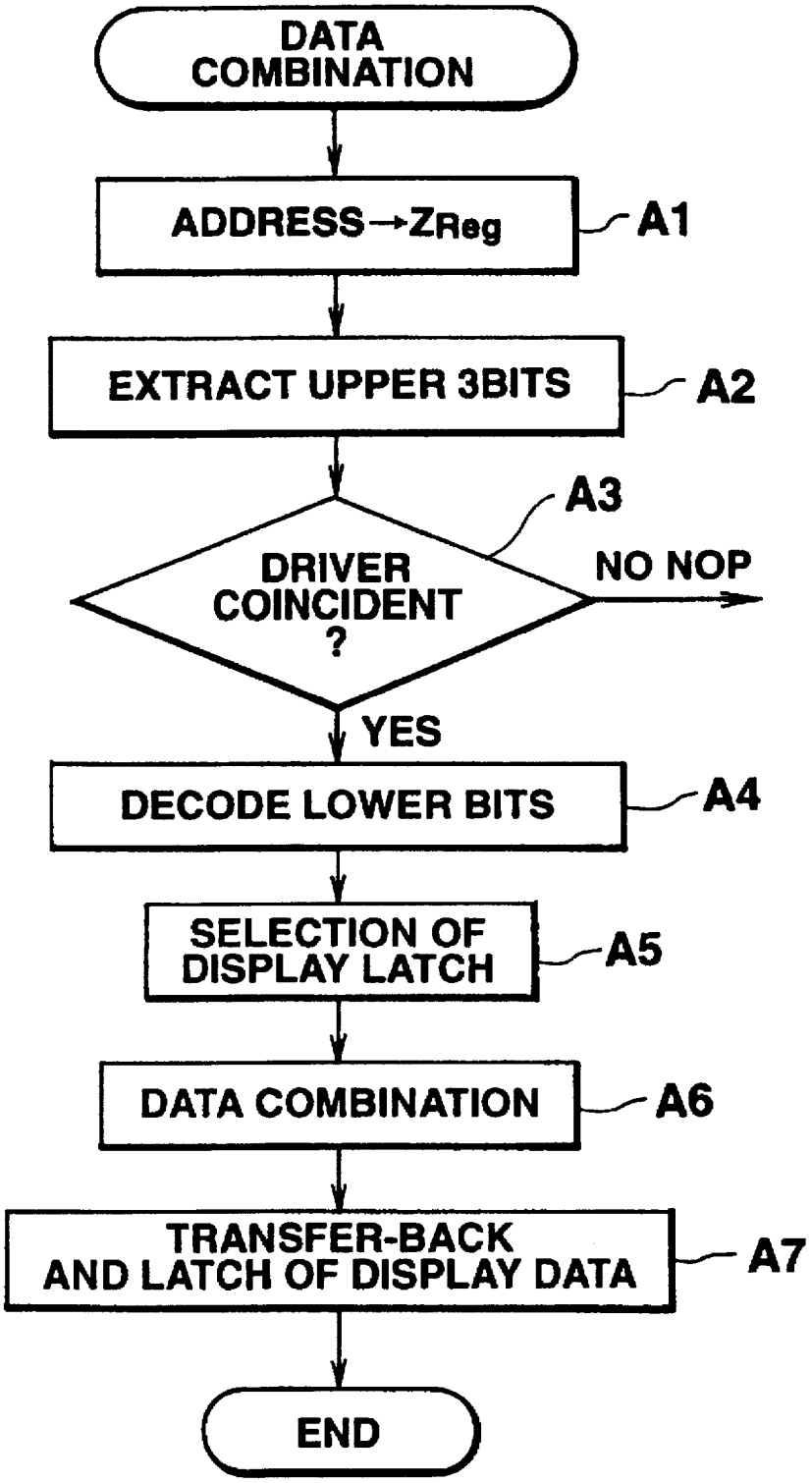
FIG. 8 is a flowchart for illustrating the display data combining operation in the segment driver of the electronic device.

FIG. 8 is a flowchart for illustrating the display data combining operation in the segment driver of the personal digital assistant. In the display data combining operation, address data and combination data are supplied from the main control device 24 in synchronism with the timing of display data combination. That is, if the 3-bit driver selection data and the 4-bit combination latch position address are supplied from the MPU 24 via the bit data bus 55 (D0 to D7) when display data of one line used for a common line driving is read out to and latched in the first latch sections L1 of the display latch circuits 51*a* to 51*o*, the combination address data constructed by the above 7 bits is held in the Z register 47*d* of the address register 47.

In this case, the upper 3-bit driver selection data held in the Z register 47*d* is supplied to the decoder 52 and whether or not the 3-bit driver selection data is coincident with the driver address ("000" in the first segment driver 41) inherent to the segment driver and previously set as (DC0) to (DC2) in the decoder 52 is determined by comparison (blocks A2, A3).

When it is determined in the decoder 52 that the driver selection data is coincident with the driver address inherent to the segment driver, the lower 4-bit combination latch position address held in the Z register 47*d* of the address register 47 is decoded in the decoder 52. One of the display latch circuits 51*a* to 51*o* is selected as the combination latch position in which display data to be combined is latched (blocks A4, A5).

In this case, if the combination latch position decoded by the decoder 52 is "0001", for example, and the display latch circuit 51*b* is selected as the combination latch position. The 8-bit display data latched in the first latch section L1 of the display latch circuit 51*b* is then transferred to the bit combining circuit 49 through the 8-bit bus 62.

Following the combination address data of 7 bits, combination data representing a cursor, for example, is supplied from the built-in RAM 32*a* of the liquid crystal timing controller 32 to the bit combining circuit 49 via the 8-bit data bus 55 (D0 to D7) and combined with data read out from the first latch section L1 (block A6).

That is, in this case, the cursor image data is combined with the display data which lies in the 8th to 15th bits latched in the first latch section L1 of the display latch circuit 51*b* selected as the combination latch position and which is contained in the one-line display data output to the segment signal generation circuit 54 when the common line is next driven.

The combined display data combined in the bit combining circuit 49 is transferred to and latched into the first latch section L1 of the display latch circuit 51*b* again. The display data is then output to the segment signal generation circuit 54 together with display data latched in the other display latch circuits 51*a*, 51*c* to 51*o* when the common line is next driven (block A7).

Therefore, combination data previously stored in the built-in RAM 32*a* of the liquid crystal timing controller 32 is combined and displayed in a given display position on the liquid crystal display section 12.

Thus, while one line display data is read out to the display latch circuits 51*a* to 51*o*, one of the display latch circuits 51*a* to 51*o* is selected and the display data to be combined is read out from the selected display latch circuit to the bit combining circuit 49, subjected to the combination process together with the combination data. The display data is then transferred back to and latched into the same one of the display latch circuits 51*a* to 51*o* so that data combination can be attained at a desired timing when display data of one line is read out. Image combination can be freely attained at high speed without rewriting the content of the display RAM 46.

Further, the overwriting combination process for the same portion can be repeatedly effected, for example, by selecting and specifying the same one of the display latch circuits 51*a* to 51*o*, deriving the logical AND of display data from the selected display latch circuit and combination data supplied via the 8-bit data bus 55 (D0 to D7), and then subjecting the result of combination to the logical OR operation.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A display data storing device in which a memory area is specified by an X address and a Y address, said display data storing device comprising:

a plurality of memories of a number which can be specified by the X address, said plurality of memories storing display data;

an address supply device for supplying the Y address to said plurality of memories;

a selector for selecting one of said plurality of memories according to the X address;

a write-in device for specifying one of said plurality of memories by the X address and the Y address, and for writing data into said specified memory;

a readout device for specifying all of said plurality of memories by the Y address to simultaneously read out data from said plurality of memories;

a plurality of latch circuits for respectively storing output data items read out from said plurality of memories;

a latch circuit for selectively storing one of the output data items read out from said plurality of memories; and a switching circuit for selecting one of said plurality of latch circuits and said latch circuit to store data.

2. The device according to claim 1, further comprising an inhibitor for inhibiting said selector from selecting one of said plurality of memories according to the X address when data is read out from said memory.

3. The device according to claim 2, wherein said selection means comprises a decoder for decoding the X address to output a selection signal for specifying one of said plurality of memories, and said inhibitor comprises a gate circuit for controlling passage of an output of said decoder.

4. The device according to claim 2, wherein said plurality of memories are included in a segment driver of a dot matrix type liquid crystal display panel, and wherein said display data storing device further comprises a data supply device for supplying data read out from said readout device to segment electrodes of said liquid crystal display panel.

5. The device according to claim 4, wherein said address supply device includes a counter which stores the Y address value and which counts in synchronism with a common signal of said liquid crystal display panel.

6. A display data storing device in which memory areas are designated by X addresses and Y addresses, said display data storing device comprising:

a plurality of memories into which Y address data are input as an address;

a control circuit for, at a time of writing data, outputting a selection signal to select one memory from said plurality of memories on the basis of an X address, and for, at a time of reading data, not outputting said selection signal, said control circuit including a decoder for inputting said X address to decode said X address into said selection signal for selecting one of said plurality of memories, and a gate circuit having a gate which is opened by said selection signal for supplying a write enable signal to the selected memory;

a group of latch circuits having a number of latch circuits in correspondence with said plurality of memories, said group of latch circuits storing output data read out from said plurality of memories;

a single further latch circuit for selectively storing one data piece of the output data read out from said plurality of memories; and a switching circuit for switching data storing to one of said group of latch circuits and said single further latch circuit.

7. The data storing device according to claim 6, wherein said single further latch circuit and said plurality of memories are connected via a gate which is opened by said selection signal produced by said decoder.

* * * * *